US011225847B2

(12) United States Patent
Liezenberg et al.

(10) Patent No.: US 11,225,847 B2
(45) Date of Patent: Jan. 18, 2022

(54) UNIVERSAL RISER JOINT FOR MANAGED PRESSURE DRILLING AND SUBSEA MUDLIFT DRILLING

(71) Applicant: Schlumberger Technology Corporation, Sugar Land, TX (US)

(72) Inventors: Bastiaan Liezenberg, Sugar Land, TX (US); Harold Tenorio, Houston, TX (US); Jeffrey Ham, Pearland, TX (US); Lap Tran, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 16/636,892

(22) PCT Filed: Aug. 13, 2018

(86) PCT No.: PCT/US2018/046577
§ 371 (c)(1),
(2) Date: Feb. 5, 2020

(87) PCT Pub. No.: WO2019/033126
PCT Pub. Date: Feb. 14, 2019

(65) Prior Publication Data

US 2020/0165888 A1 May 28, 2020

Related U.S. Application Data

(60) Provisional application No. 62/544,319, filed on Aug. 11, 2017, provisional application No. 62/560,658, filed on Sep. 19, 2017.

(51) Int. Cl.

| | |
|---|---|
| ***E21B 21/08*** | (2006.01) |
| ***E21B 21/00*** | (2006.01) |
| ***E21B 21/10*** | (2006.01) |

(52) U.S. Cl.
CPC ..... *E21B 21/08* (2013.01); *E21B 21/001* (2013.01); *E21B 21/106* (2013.01)

(58) Field of Classification Search
CPC ..... E21B 17/01; E21B 21/001; E21B 21/08; E21B 21/106
See application file for complete search history.

(56) References Cited

U.S. PATENT DOCUMENTS

| | | | |
|---|---|---|---|
| 3,934,887 | A | 1/1976 | Biffle |
| 4,210,208 | A | 7/1980 | Shanks |

(Continued)

FOREIGN PATENT DOCUMENTS

| | | | |
|---|---|---|---|
| GB | 2541755 | A | 3/2017 |
| WO | 03023181 | A1 | 3/2003 |

(Continued)

OTHER PUBLICATIONS

International Preliminary Report on Patentability for the counterpart International patent application PCT/US2018/046577 dated Feb. 20, 2020.

(Continued)

*Primary Examiner* — James G Sayre
(74) *Attorney, Agent, or Firm* — Kelly McKinney

(57) ABSTRACT

An apparatus includes a tube having at least one flow outlet in communication with an interior of the tube. The apparatus includes valves for selectively connecting the flow outlet to one of a fluid return line and an inlet of a fluid pump. The apparatus also includes valves for selectively connecting the outlet of the pump to the fluid return line and closing the pump outlet. A method includes returning mud from a wellbore into a riser extending between the wellbore and a drilling unit on the surface of a body of water. Flow from a tube in the riser is selectively diverted to an inlet to a fluid pump or a mud return line extending from the tube to the (Continued)

drilling unit. When the flow is diverted to return mud flow in the riser is stopped above the tube. When flow is diverted to the inlet of the pump, the pump is operated to lift the mud to maintain a selected mud pressure in the wellbore.

16 Claims, 4 Drawing Sheets

(56) References Cited

U.S. PATENT DOCUMENTS

| | | | | |
|---|---|---|---|---|
| 4,291,772 | A | 9/1981 | Beynet | |
| 4,480,703 | A | 11/1984 | Garrett | |
| 5,848,643 | A | 12/1998 | Caarbaugh et al. | |
| 6,102,673 | A | 8/2000 | Mott et al. | |
| 6,904,981 | B2 | 6/2005 | Riet | |
| 7,185,719 | B2 | 3/2007 | Riet | |
| 7,350,597 | B2 | 4/2008 | Reitsma et al. | |
| 9,057,233 | B2 * | 6/2015 | Ree | E21B 21/10 |
| 2007/0095540 | A1 | 5/2007 | Kozicz et al. | |
| 2012/0318496 | A1 | 12/2012 | Bailey et al. | |
| 2014/0048331 | A1 | 2/2014 | Boutalbi et al. | |
| 2015/0083429 | A1 * | 3/2015 | Reitsma | E21B 44/00 166/335 |
| 2016/0076323 | A1 * | 3/2016 | Fraczek | E21B 21/08 166/367 |
| 2016/0290088 | A1 | 10/2016 | DeWesee, Jr. | |
| 2017/0089169 | A1 | 3/2017 | Stave | |

FOREIGN PATENT DOCUMENTS

| | | | | |
|---|---|---|---|---|
| WO | 2011058031 | A2 | 5/2011 | |
| WO | 2017/003406 | A1 | 1/2017 | |
| WO | WO-2017003406 | A1 * | 1/2017 | E21B 17/012 |
| WO | 2019/060233 | A1 | 3/2019 | |

OTHER PUBLICATIONS

International Search Report and Written Opinion for the International patent application PCT/US2018/051270 dated Jan. 28, 2019.
International Search Report and Written Opinion for the International patent application PCT/US2018/046577 dated Dec. 11, 2018.
Search and Examination Report issued in European Patent Application No. 18844975.5 dated Feb. 26, 2021, 6 pages.

* cited by examiner

UNIVERSAL RISER JOINT FOR MANAGED PRESSURE DRILLING AND SUBSEA MUDLIFT DRILLING

CROSS REFERENCE TO RELATED APPLICATIONS

This application claims the benefit of priority to U.S. Provisional Patent Application 62/544,319, filed on Aug. 11, 2017, and U.S. Provisional Patent Application 62/560,658, filed on Sep. 19, 2017, the entire content of which is incorporated herein by reference.

BACKGROUND

This disclosure relates to the field of wellbore drilling. More specifically, the disclosure relates to marine drilling through a conduit ("riser") extending from a subsea wellhead proximate the bottom of a body of water to a drilling unit on the water surface.

Marine wellbore drilling includes locating a drilling unit on a platform at the surface of a body of water. A surface casing may extend from proximate the water bottom to a selected depth into the formations below the water bottom. A valve system ("wellhead") may be coupled to the top of the surface casing proximate the water bottom. A conduit called a "riser" may be coupled to the top of the wellhead, e.g., through a lower marine riser package ("LMRP") and may extend to the drilling unit on the water surface. During drilling, a drill string may be extended from the drilling unit, through the riser, LMRP, wellhead and surface casing and into the formations below the bottom of the surface casing in order to extend the length of the wellbore. Drilling fluid ("mud") may be pumped through the drill string by pumps located on the drilling unit. The mud is discharged through the bottom of the drill string from a drill bit coupled to the bottom of the drill string. The mud moves upwardly through an annular space ("annulus") between the drill string and the wall of the drilled wellbore, and subsequently the surface casing, wellhead, LMRP and riser ultimately to be returned to the drilling unit on the water surface.

Some drilling procedures include changing the fluid pressure exerted by the column of mud in the annulus. Such drilling procedures include "managed pressure drilling" (MPD) wherein a sealing element, called a rotating control device ("RCD") is disposed at a selected longitudinal position in the annulus and a fluid outlet is provided below the RCD such that returning mud from the annulus may have its flow rate and/or pressure controlled, for example, using an adjustable orifice choke or other flow control device. MPD may enable using different density ("weight") mud than would otherwise be required in order to provide sufficient hydrostatic pressure to keep fluid in exposed formations in the wellbore from entering the wellbore. An example method for MPD is described in U.S. Pat. No. 6,904,981 issued to van Riet, U.S. Pat. No. 7,185,719 issued to van Riet, and U.S. Pat. No. 7,350,597 issued to Reitsma.

Other drilling procedures (referred to as subsea mudlift drilling or "SMD drilling") may provide lower pressure in the annulus than would otherwise exist as a result of the hydrostatic pressure of the mud in the annulus. The lower pressure may be provided by using a pump ("SMD pump") disposed at a selected elevation below the water surface, having its suction side in fluid communication with the annulus and its discharge connected to a mud return line extending to the drilling unit on the water surface. By selectively operating the SMD pump, a selected fluid pressure may be maintained in the annulus. An example method for SMD drilling is described in U.S. Pat. No. 4,291,772 issued to Beynet.

It is desirable to have a riser readily and efficiently reconfigurable for SMD drilling, MPD drilling and conventional drilling without the need to substantially disassemble the riser.

DETAILED DESCRIPTION

Figure 1:
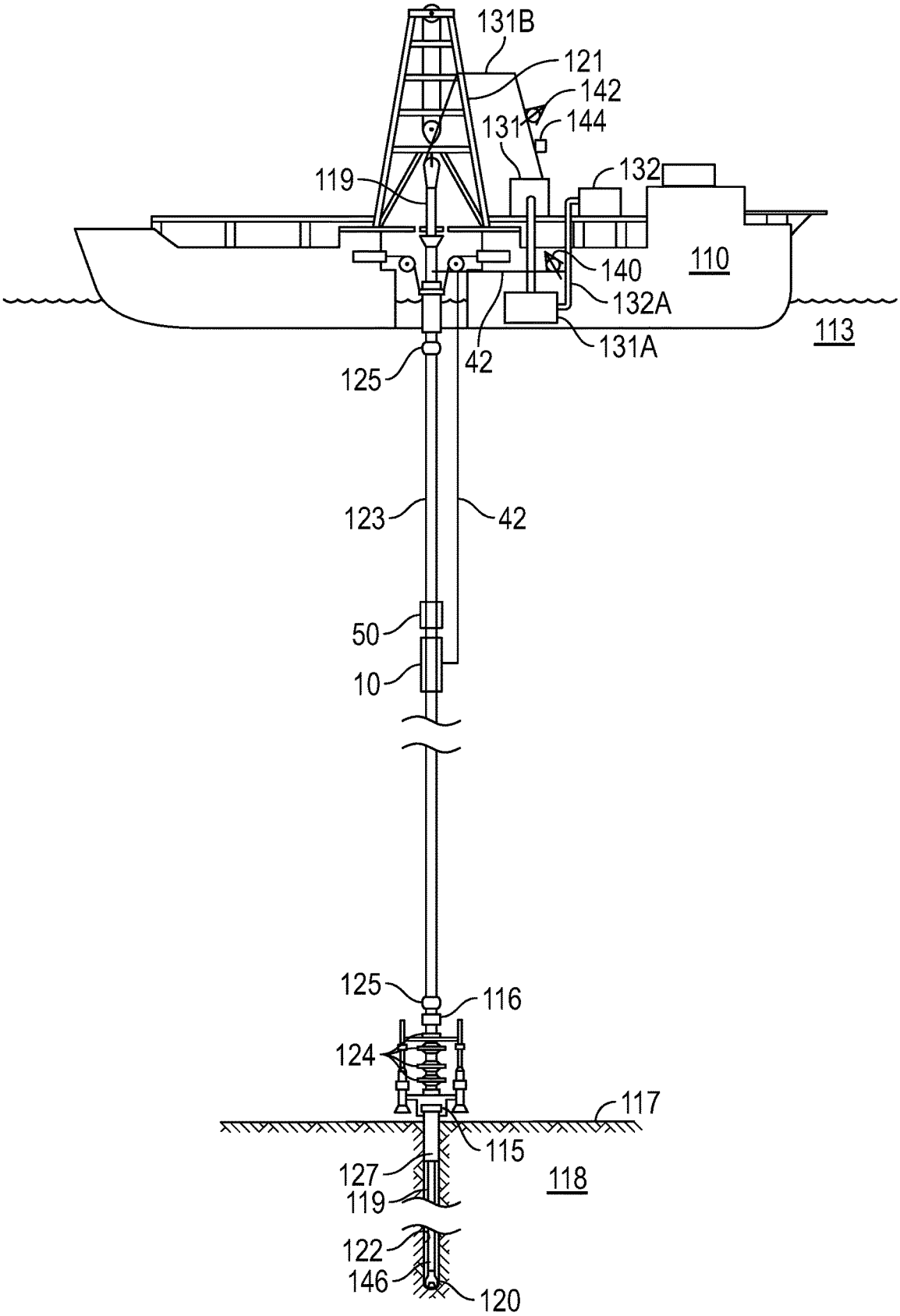
FIG. 1 shows an example marine drilling system including a riser having a riser joint according to the present disclosure.

FIG. 1 shows an example marine drilling system. A drilling vessel 110 floats on the surface of a body of water 113. A wellhead 115 is positioned on the water bottom 117. The wellhead 115 defines the upper surface or "mudline" of a wellbore 122 drilled through sub-bottom formations 118. A drill string 119 having a drill bit 120 disposed at a bottom end thereof are suspended from a derrick 121 mounted on the drilling vessel 110. The drill string 119 may extend from the derrick 121 to the bottom of the wellbore 122. A length of structural casing 127 extends from the wellhead 115 to a selected depth in the wellbore 122. In the present example embodiment a riser 123 may extend from the upper end of a blowout preventer stack 124 coupled to the wellhead 115, upwardly to the drilling vessel 110. The riser 123 may comprise flexible couplings such as ball joints 125 proximate each longitudinal end of the riser 123 to enable some movement of the drilling vessel 110 without causing damage to the riser 123.

A riser segment 10, which will be explained in more detail with reference to FIGS. 2, 3 and 4, may be disposed at a selected longitudinal position along the riser 123. In the present example embodiment, the riser segment 10 may be disposed below a housing 50 configured to receive a rotating control device (RCD) bearing and seal assembly (explained with reference to FIGS. 5 and 6). The riser segment 10 may comprise a mud return line 42 which will be further explained with reference to FIG. 2. The mud return line 42 in some embodiments may be connected to a flowmeter 140 to measure the rate at which fluid is discharged from the riser 123, and thus from the wellbore 122. A drilling fluid ("mud") treatment system 132 which may comprise components (none shown separately for clarity) such as a gas separator, one or more shaker tables, and a clean mud return line 132A which returns cleaned mud to a tank or reservoir 131A.

A pump 131 disposed on the drilling vessel 110 may lift mud from the tank 131A and discharge the lifted mud into a standpipe 131B or similar conduit. The standpipe 131B is in fluid communication with the interior of the drill string 119 at the upper end of the drill string 119 such that the discharged mud moves through the drill string 119 downwardly and is ultimately discharged through nozzles, jets, or courses through the drill bit 120 and thereby into the wellbore 122. The mud moves along the interior of the wellbore 122 upwardly into the riser 123 until it reaches the riser segment 10. Further movement of the mud beyond the riser segment 10 will be further explained with reference to FIGS. 2 through 4. A pressure sensor 144 and a flowmeter 142 may be placed in fluid communication with the pump 131 discharge at any selected position between the pump 131 and the upper end of the drill string 119. The pressure sensor 144 may measure pressure of the mud in the standpipe 131B and the flowmeter 142 may measure rate of flow of the mud through the standpipe 131B to enable determining pressure of the mud at any longitudinal position along the wellbore 122 and/or the riser 123.

In some embodiments, a pressure sensor may be disposed proximate the bottom end of the drill string 119, such pressure sensor being shown at 146. Such pressure sensor may have its measurements communicated to the drilling vessel 110 using signal transmission devices known in the art.

Figure 2:
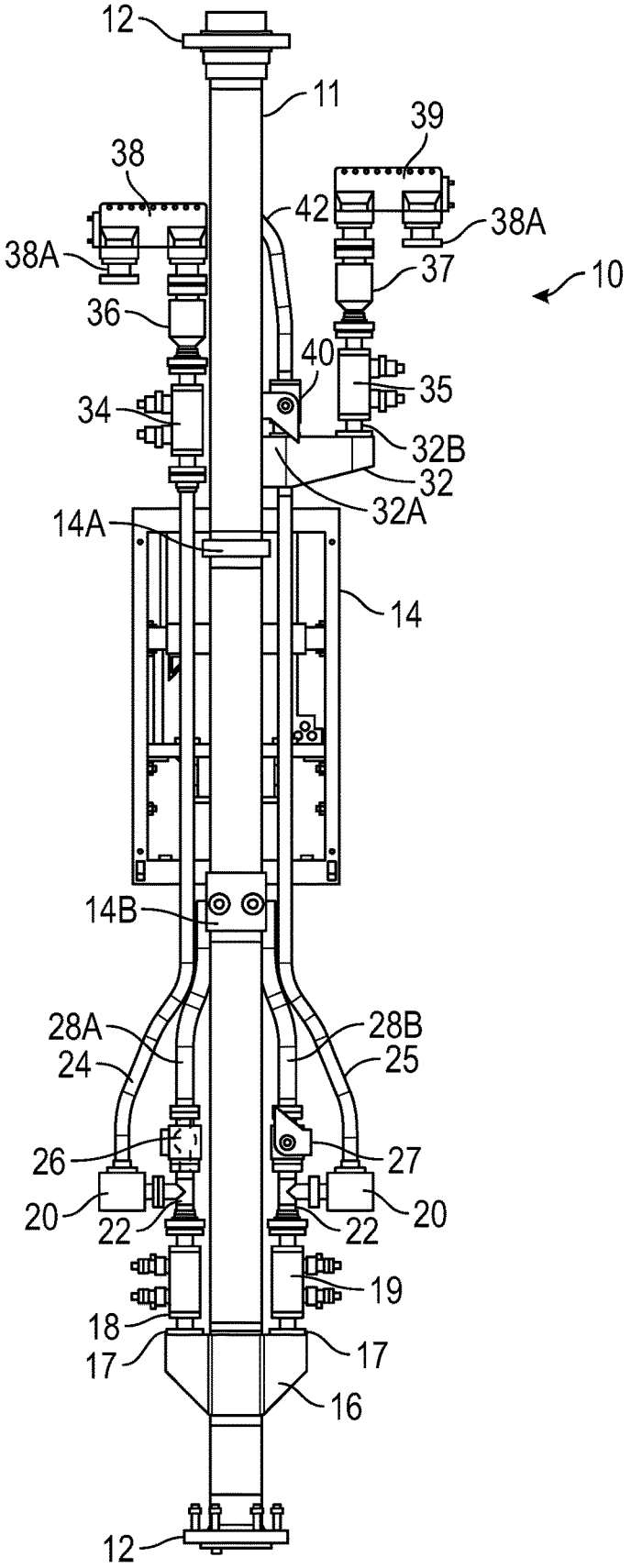
FIG. 2 shows a side view of an example embodiment of a riser joint according to the present disclosure.

FIG. 2 shows an example riser segment ("joint") according to various aspects of the present disclosure. The riser joint 10 may comprise a tube 11 having dimensions and made from materials known in the art for marine drilling risers. The tube 11 may comprise a connecting flange 12 at each longitudinal end of the tube 11. The flanges 12 may be configured in any manner known in the art for connecting riser joints longitudinally end to end.

A flow diverter manifold 16 may be coupled to the tube 11, as shown in FIG. 2 proximate the lower end of the tube 11. The flow diverter manifold 16 may have at least one, and in the present embodiment may have two fluid outlets 17 each in fluid communication with the interior of the tube 11. Each fluid outlet 17 may have a valve 18, 19, for example a double isolated valve block, coupled at one end thereof to a respective fluid outlet 17 such that each fluid outlet 17 may be selectively opened or closed to flow from the interior of the tube 11.

The other end of each valve 18, 19 may be coupled to respective a flow "tee" 22, whereby fluid leaving the tube 11 may be selectively provided to one or both of a flow line 24 and a SMD pump conduit 28A, 28B. The SMD pump conduits 28A, 28B may be selectively opened to and closed to flow to the respective flow tee 22 by respective valves 26, 27 disposed between an end of each SMD pump conduit 28A, 28B and the corresponding flow tee 22. In the present embodiment, each flow line 24 may be connected to the corresponding flow tee 22 using a right angle flow block 20, however, such configuration using right angle flow blocks 20 is only meant to serve as an example and is not a limit on the scope of the present disclosure.

In the present example embodiment, one of the SMD pump conduits 28A may be fluidly connected to an intake of an SMD pump (not shown in FIG. 2). The other SMD pump conduit 28B may be fluidly connected to a discharge of the SMD pump (not shown in FIG. 2).

One of the flow lines 24 may be fluidly connected to a valve 34, which may be a double isolated valve block and from the valve 34 to a first "gooseneck" 38. The first gooseneck 38 may be connected to the valve 34 using a stab in connector 36, and may have an outlet connector 38A for coupling to, for example, a flexible fluid hose (not shown in the figures). The other of the flow lines 25 may be fluidly connected to a manifold 32, which in some embodiments may be a swing arm manifold 32. One outlet 32A of the swing arm manifold 32 may be connected to a valve 40 which may selectively open and close fluid communication between the one outlet 32A of the swing arm manifold 32 and a mud return line 42. Another outlet 32B of the swing arm manifold 32 may be connected to a valve 35, which in some embodiments may be a double isolated valve block. The valve 35 may be in fluid communication with a second gooseneck 39 also having a connector 38A for coupling, for example, to a flexible hose (not shown in the figures). The second gooseneck 39 may be coupled to the valve 35 using a stab in connector 37 similar in configuration to the stab in connector 36 coupled to the first gooseneck 38.

A frame 14 may be coupled to the tube 11 using reinforcements 14A, 14B proximate the respective upper and lower ends of the frame 14. The frame 14 may provide a mounting place for the previously described SMD pump (not shown in FIG. 2). The frame 14 may be permanently mounted to the tube 11 in some embodiments. In some embodiments, the frame 14 may be removably mounted to the tube 11.

Figure 3:
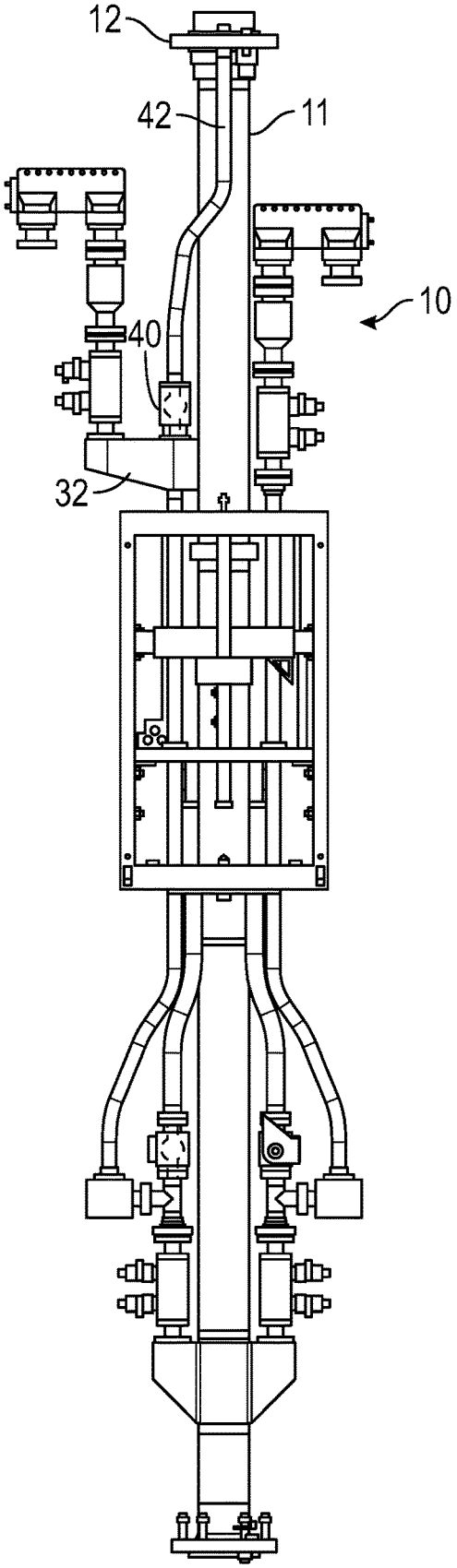
FIGS. 3 and 4 show different views of the example embodiment of the riser joint shown in FIG. 2.

Another view of the riser joint 10 is shown in FIG. 3, wherein may be observed the mud return line 42 extending from the valve 40, which itself is coupled to the swing arm manifold 32. The mud return line 42 may extend through a suitable opening in the flange 12 proximate the top of the tube 11. Each riser joint (not shown in FIG. 3) coupled above the riser joint 10 and below the riser joint 10 according to the present disclosure may comprise a segment of conduit (not shown) to connect the mud return line 42 to the drilling unit on the water surface.

Figure 4:
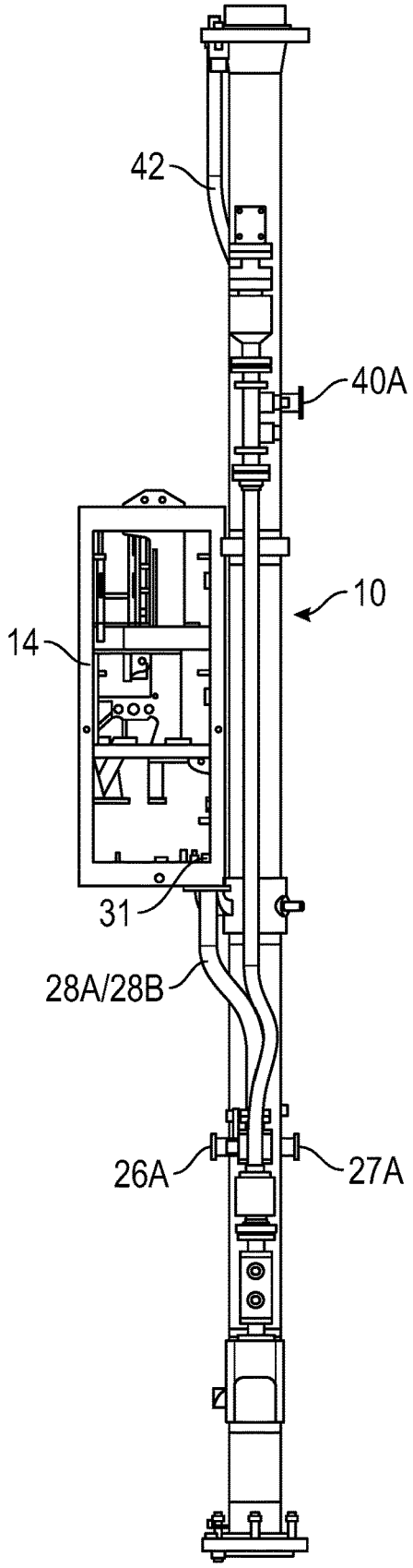

FIG. 4 shows a side view of the riser joint 10 rotated 90 degrees from the view shown in FIGS. 2 and 3, wherein may be observed an ROV stab 40A to operate the valve (40 in FIG. 2) to open and close fluid flow to the mud return line 42. ROV stabs 26A, 27A may be provided to operate the corresponding valves (26, 27 in FIG. 2) that open and close the SMD pump conduits (28A, 28B in FIG. 2) to flow. Also observable in FIG. 4 are supports 31 for mounting the SMD pump (not shown in the figures).

The riser joint 10 shown in FIGS. 2, 3 and 4 may be used in several configurations for conventional drilling, SMD drilling and MPD drilling. For conventional drilling, valves 18, 19, 26, 27, 34, 35 and 40 may be closed. Riser segments coupled to the riser joint 10 above and below the riser joint may be ordinary riser joints having only a tube, and flanges at the longitudinal ends thereof.

In some embodiments, one of the riser segments above the riser joint 10 may comprise a housing (see 50 in FIG. 1) for receiving a RCD bearing and seal assembly in the event it is desired to change from conventional drilling to MPD drilling without the need to disassemble any part of the riser (FIG. 1). As will be appreciated by those skilled in the art, the RCD bearing and seal receiver (FIG. 1) may freely enable passage of a drill string therethrough so as not to interfere in any way with conventional drilling. When it is desired to change to MPD drilling, a RCD bearing and seal assembly may be assembled to the drill string (FIG. 1) and moved into the RCD bearing and seal receiver using the drill string. The drill string may be advanced to the bottom of the wellbore to resume drilling, among other well operations. For MPD drilling, and returning to FIG. 2, valves 18, 19, 26, 27, 34, 35 and 40 are initially closed. The valve 19 shown on the right hand side of the flow diverter manifold 16 may be opened. If the mud return line 42 is to be used for return of the mud to the drilling unit, valve 40 may be opened. In some embodiments if the second gooseneck 39 is to be coupled to a flexible hose (not shown) to return mud to the drilling unit, valve 40 may be closed and valve 35 on the right hand side of the tube 11 in FIG. 2 may be opened. As more fully set forth in U.S. Pat. No. 6,904,981 issued to van Riet, U.S. Pat. No. 7,185,719 issued to van Riet, and U.S. Pat. No. 7,350,597 issued to Reitsma, MPD drilling may proceed by providing a selected flow restriction from the mud return line 40 or the flexible hose (not shown) to maintain a selected mud pressure in the annulus.

To perform SMD drilling using the riser joint 10 and still with reference to FIG. 2, valves 18, 19, 26, 27, 34, 35 and 40 are initially closed. The valve 18 on the left hand side of the tube 11 may be opened. The valve 26 connecting valve 18 to the SMD pump conduit 28A may be opened so that fluid leaving the tube 11 through the flow diverter manifold 16 may be drawn into the SMD pump (FIG. 1). The valve 19 on the right hand side of the tube 11 may remain closed, while the valve 27 at the lower end of the SMD pump conduit 28B may be opened. Discharge from the SMD pump (FIG. 1) may enter the SMD pump conduit 28B, pass through the open valve 27, and because the valve 19 on the right hand side of the tube 11 is closed, the flow may be diverted into the flow tee 22 and then into the flow line 25 connected thereto and to the swing arm manifold 32. Valve 40 may be opened to use the mud return line as a SMD pump flow return line, or valve 39 connected to the swing arm manifold 32 may be opened if a flexible hose (not shown) is connected to the second gooseneck 39 to provide a return flow path for the mud discharged from the SMD pump (FIG. 1). As will be appreciated by those skilled in the art, SMD drilling may not require a RCD, and the RCD bearing and seal assembly may be omitted from the drill string for SMD drilling.

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. An apparatus comprising:

a tube having at least one flow outlet in communication with an interior of the tube;

a fluid return line;

a fluid pump comprising a pump inlet and a pump outlet;

valves for selectively connecting the flow outlet to one of the fluid return line and the pump inlet;

valves for selectively connecting the pump outlet to the fluid return line and closing the pump outlet, wherein the at least one flow outlet comprises a manifold having two separate flow outlets each in fluid communication with the interior of the tube, and wherein each of the two separate flow outlets comprises a valve arranged to close fluid communication between the respective flow outlet and the interior of the tube; and a flow tee connected to each valve arranged to close fluid communication between the respective flow outlet and the interior of the tube, a first outlet of each flow tee connected to a subsea mudlift drilling pump conduit.

2. The apparatus of claim 1 further comprising a connector flange disposed at each longitudinal end of the tube.

3. The apparatus of claim 1 further comprising a housing adapted to receive a rotating control device bearing and seal assembly disposed above the tube.

4. The apparatus of claim 1 further comprising a frame coupled to an exterior of the tube for retaining the fluid pump.

5. The apparatus of claim 1 wherein one of the subsea mudlift drilling pump conduits is fluidly connected to the pump inlet.

6. The apparatus of claim 1 wherein one of the subsea mudlift drilling pump conduits is fluidly connected to the pump outlet.

7. The apparatus of claim 1 wherein a second outlet of each flow tee is connected to a flow line.

8. The apparatus of claim 7 wherein each flow line comprises a valve to selectively close an outlet of each flow line.

9. The apparatus of claim 7 wherein each flow line is connected to a respective gooseneck.

10. The apparatus of claim 9 wherein each gooseneck comprises a connector adapted to connected to a flexible hose.

11. The apparatus of claim 1 wherein the tube forms a segment of a riser.

12. A method, comprising:

returning mud from a wellbore into a riser extending between the wellbore and a drilling unit on the surface of a body of water, the riser comprising a riser segment including a tube, a fluid pump, and a mud return line;

selectively diverting flow from within the tube in the riser to one of an inlet to the fluid pump and a mud return line extending from the tube to the drilling unit using a manifold coupled to the tube, the manifold comprising two separate flow outlets each in fluid communication with an interior of the tube, wherein each of the two separate flow outlets comprises a valve arranged to close fluid communication between the respective flow outlet and the interior of the tube, wherein the valve is connected to a flow tee, a first outlet of the flow tee being connected to a subsea mudlift drilling pump conduit; and when the flow is selectively diverted to the mud return line, stopping mud flow in the riser above the tube, and when flow is selectively diverted to the inlet of the fluid pump, operating the fluid pump to lift the mud to the drilling unit so as to maintain a selected mud pressure in the wellbore.

13. The method of claim 12 wherein when the mud is selectively diverted to the mud return line, controlling discharge of mud from the mud return line to maintain a selected mud pressure in the wellbore.

14. The method of claim 13 wherein the controlling discharge comprises operating a controllable orifice choke fluidly connected to the mud return line.

15. The method of claim 12 wherein the selectively diverting flow comprises operating valves to:

(i) close fluid flow to the inlet of the fluid pump;

(ii) open fluid communication from the tube to the mud return line; and (iii) close fluid communication to an outlet of the fluid pump.

16. The method of claim 12 wherein the stopping flow in the riser comprises inserting a drill string having a rotating control device bearing and seal assembly thereon into the wellbore such that the rotating control device bearing and seal assembly engages a housing disposed above the tube.

* * * * *